United States Patent [19]

Deininger

[11] 4,047,620

[45] Sept. 13, 1977

[54] PILL AND CAPSULE COUNTER

[76] Inventor: Warren L. Deininger, 14 Southern Drive, Decatur, Ill. 62521

[21] Appl. No.: 621,510

[22] Filed: Oct. 10, 1975

[51] Int. Cl.[2] ..... B65B 67/02

[52] U.S. Cl. ..... 214/1 C; 221/266; 222/289

[58] Field of Search ..... 214/1 C; 221/266; 133/8, 1 A; 141/246, 247; 222/288, 289

[56] References Cited

U.S. PATENT DOCUMENTS

| | | | |
|---|---|---|---|
| 702,083 | 6/1902 | Wormwood | 222/289 X |
| 2,623,647 | 12/1952 | Erickson | 214/1 C |
| 2,863,572 | 12/1958 | Bethard et al. | 214/1 C |
| 3,848,395 | 11/1974 | Totten | 214/1 C X |

*Primary Examiner*—Robert B. Reeves
*Assistant Examiner*—Francis J. Bartuska
*Attorney, Agent, or Firm*—Grace J. Fishel

[57] ABSTRACT

A counter for discrete objects such as pills and capsules having a tray with pill and capsule receiving sides in back to back relationship, each side having a movable slider for selecting the number of recesses in said side to be filled, said tray being pivotable to dispense the counted objects.

13 Claims, 9 Drawing Figures

PILL AND CAPSULE COUNTER

This invention relates to a device for automatically counting discrete objects such as pills and capsules.

Various simple devices have been proposed for automatically counting pills by dumping them on a tray having a number of pill receiving recesses. These devices, like the present device, provide a convenient means to determine the number of pills on the tray without going through the trouble of counting them individually. There is also less chance of mistake in counting with consequent loss of profit for the pharmacist or risk of legal liability for negligence. Typical prior art devices of this type include those described in U.S. Pat. Nos. 707,062, 2,771,198, 2,812,076, 2,863,572, 3,150,785, 3,402,827, 3,662,904 and 3,848,395. None of these devices, however, provides a convenient means for counting odd numbers of medicinal units. Moreover, in some it is difficult to remove excess units and to dispense counted units quickly.

In addition to the devices discussed above, there are also electronic counting machines wherein the pills or capsules are spun around a carousel and are counted as they pass an electric eye. Generally the machine does not distinguish between whole and broken units so that broken pills or capsules are counted as whole. This is troublesome to the patient where dosage is critical. Moreover, as the pills and capsules are spun on the carousel, they are abraded and the resultant dust interferes with the electric eye. This dust may also contaminate the next batch of pills or capsules counted therein. Thus, it is necessary to clean the machine frequently. Since it takes several hours to clean some of these machines, frequent cleaning is burdensome and is regarded by some pharmacists as outweighing the advantages.

In view of the above, among the several objects of the present invention may be noted the provision of a simple, time-saving, easy-to-clean device for automatically and hygienically counting and dispensing pills and capsules, said device providing improved means for counting odd numbers of both pills and capsules, for easily removing excess or imperfect units, and for quickly dispensing the counted units. Other objects and features will be in part apparent and in part pointed out hereinafter.

The invention accordingly comprises the constructions hereinafter described, the scope of the invention being indicated in the following claims.

In the accompanying drawings, in which one of various possible embodiments of the invention is illustrated, FIG. 1 is a perspective view of a counter constructed according to the present teachings and having a rotatable tray with pill receiving recesses and a slider for counting odd numbers of pills on one side and with capsule receiving recesses and a slider for counting odd numbers of capsules on the other side;

Corresponding reference characters indicate corresponding parts throughout the several views of the drawings.

Figure 7:
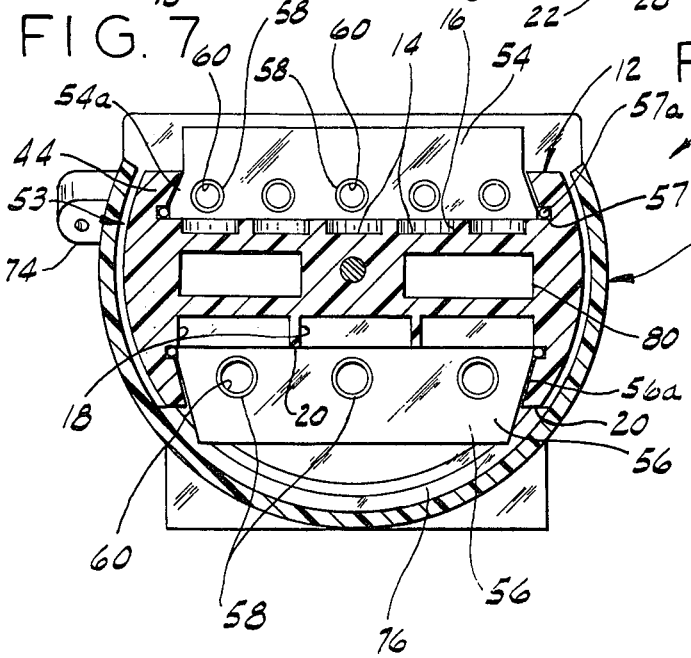
FIG. 7 is an enlarged transverse cross-section taken along line 7—7 in FIG. 3.

Referring to the drawings, a pill and capsule counter 10 according to the present invention includes a tray 12 with a plurality of pill receiving recesses 14 on one side 16 and a plurality of capsule receiving recesses 18 on the other side 20. Since capsules are usually formed in two sections, one slipped over the mouth of the other, it is preferred that the edges of recesses 18 be rounded as shown in FIG. 7 to prevent the capsules from catching on the rim where the sections join.

Figure 3:
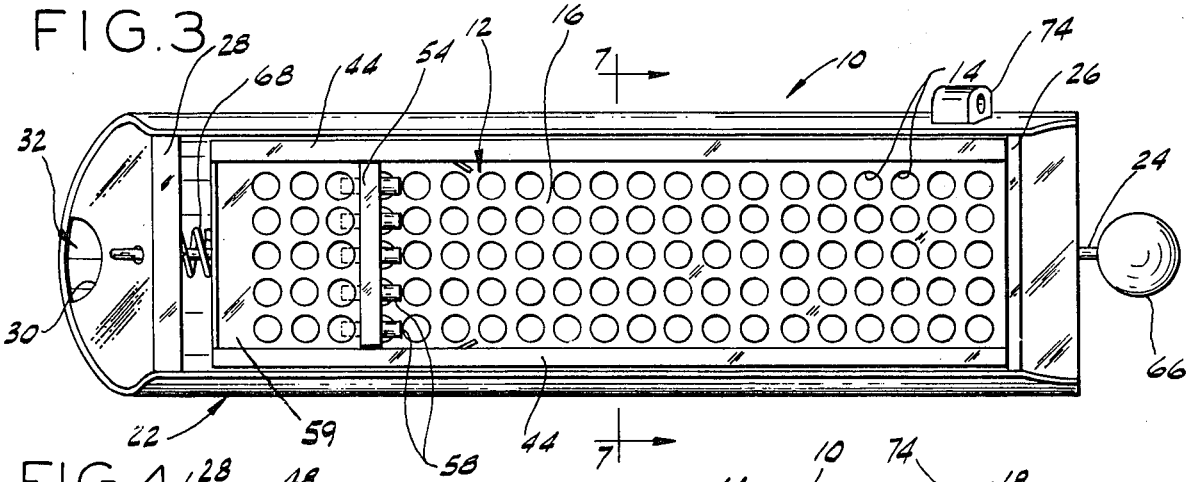
FIG. 3 is a plan view of the counter with the pill side of the tray up; shown in broken lines is the slider for counting odd numbers of pills in moved position.
Figure 4:
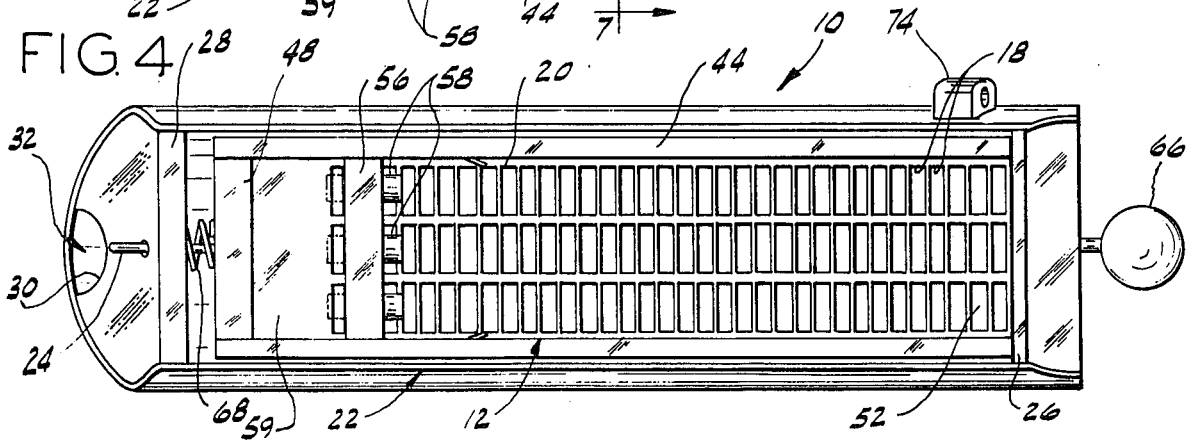
FIG. 4 is a plan view of the counter with the capsule side of the tray up; shown in broken lines is the slider for counting odd numbers of capsules in moved position.
Figure 9:
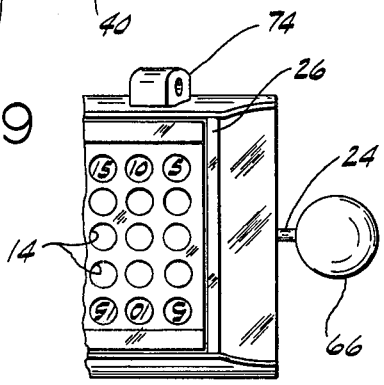
FIG. 9 is a plan view similar to FIG. 3 except that the left end of the counter is broken away and number indicia are provided in selected pill receiving recesses.

As best seen in FIGS. 3 and 4, recesses 14 and 18 are preferably arranged in ranks and files. On pill side 16 of tray 12, there are five recesses in each rank and 20 recesses in each file and on capsule side 20 there are three recesses in each rank and 34 recesses in each file. The particular arrangement shown, especially as to pill side 16, was selected because counts therewith are readily convertible into decimal numbers. Other arrangements and numbers of recesses could, however, be utilized. Indicia may be provided in the bottoms of selected recesses 14 and 18 as shown in FIG. 9 to facilitate counting. If the indicia are arranged as shown, counting with counter 10 as hereinafter described is eased for both right- and left-handed operators.

As described hereinafter, it is contemplated that a pharmacist will have two counters 10, differing by the size of trays 12 and of recesses 14 and 18 to accommodate the usual range of pill and capsule sizes. Since it is a matter of preference how many counters 10 are utilized, more or less could be used but two are adequate when smaller tray 12 is $2\frac{1}{4}$ inches wide by 10 inches long and pill recesses 14 are $\frac{3}{8}$ inch wide and 1/16 inch deep while capsule recesses 18 are $\frac{5}{8}$ inch long, $\frac{1}{4}$ inch wide and 3/16 inch deep. Larger tray 12 is then 3 inches wide and 12 inches long with pill recesses 18 15/16 inch long, 5/16 inch wide and $\frac{1}{4}$ inch deep. Other dimensions for recesses 14 and 18 can be used as desired.

The particular counter 10 selected will depend upon the dimensions of the pills or capsules to be counted. As will be readily appreciated, recesses 14 and 18 should not be deeper than the medicinal unit is thick otherwise more than one unit may lie on top of the other in a given recess. Similarly, recesses 14 and 18 should have a diameter or width less than twice the diameter of the pills or width of the capsules being counted otherwise two units are accommodated in side-by-side relationship in a given recess. Similar considerations apply as to the length of recesses 18. In general, recesses 14 and 18 should be so selected as to be large enough to accept the medicinal units being counted but small enough to exclude two such units.

Tray 12 is pivotally mounted with respect to a housing 22 on a shaft 24 which is journaled in right and left housing end walls 26 and 28, respectively. As shown, housing 22 is arcuate in cross-section and is substantially half of a cylinder. As viewed in the figures, right housing end wall 26 is substantially perpendicular to the long axis of housing 22 and is spaced inwardly from one edge thereof while left housing end wall 28 slopes at an acute angle thereto and is adjacent the other edge of housing 22.

Left housing end wall 28 has a discharge opening 30. Since left housing end wall 28 slopes at an acute angle to the housing, the housing forms a projecting lip or spout 32 which functions somewhat as a funnel for guiding pills or capsules into a receptacle.

A handle is provided generally as a flange 34 attached to right housing end wall 26 and through which shaft 24 is also journaled. A downwardly extending lip 36 is provided on flange 34 to facilitate gripping in combination with an upstanding flange 38 on housing 22. It will be apparent that downwardly extending lip 36 and upstanding flange 38 should be spaced to accommodate a user's fingers in a gap 40 formed therebetween. Upstanding flange 38 also extends downwardly beyond housing 22 to define a leg 42 for engaging a supporting surface and keeping counter 10 from rolling over.

Tray 12 has side flanges 44 along sides 46, an end flange 48 along one end 50 and is open at an opposite end 52. Flanges 44 and 48 slope inwardly on both sides 16 and 20 and are provided to retain pills or capsules poured on the tray. In pill or capsule receiving position, as shown in all figures except FIG. 6, right housing end wall 26 serves as a flange for retaining the medicinal units at open end 52 of tray 12.

As shown in FIG. 7, sides 46 are arcuate in cross-section and are sized so that there is a small space 53 between them and housing 22. This is preferred to prevent pills or capsules from inadvertently falling therethrough or becoming stuck therein. On the other hand, there must be sufficient space between sides 46 and housing 22 so that tray 12 is freely rotated as described hereinafter. Alternatively, the space between sides 46 and housing 22 is formed sufficiently large so that a pill or capsule from tray 12 may freely fall therethrough.

A first slider 54 is provided on pill side 16 and a second slider 56 is provided on capsule side 20. Sliders 54 and 56 have sloping sides **54*a* and 56*a*, respectively, and are cooperatively fitted between sloping side flanges 44 on tray 12. Flanges 44 each have a horizontally extending groove 57 along which a pair of resiliently biased wires 57*a* slide. Wires 57*a* are attached to sloping sides 54*a* and 56*a* as shown. Other suitable means for retaining sliders 54 and 56** so that they are not easily wedged as will occur to those skilled in the art are also contemplated.

Figure 1:
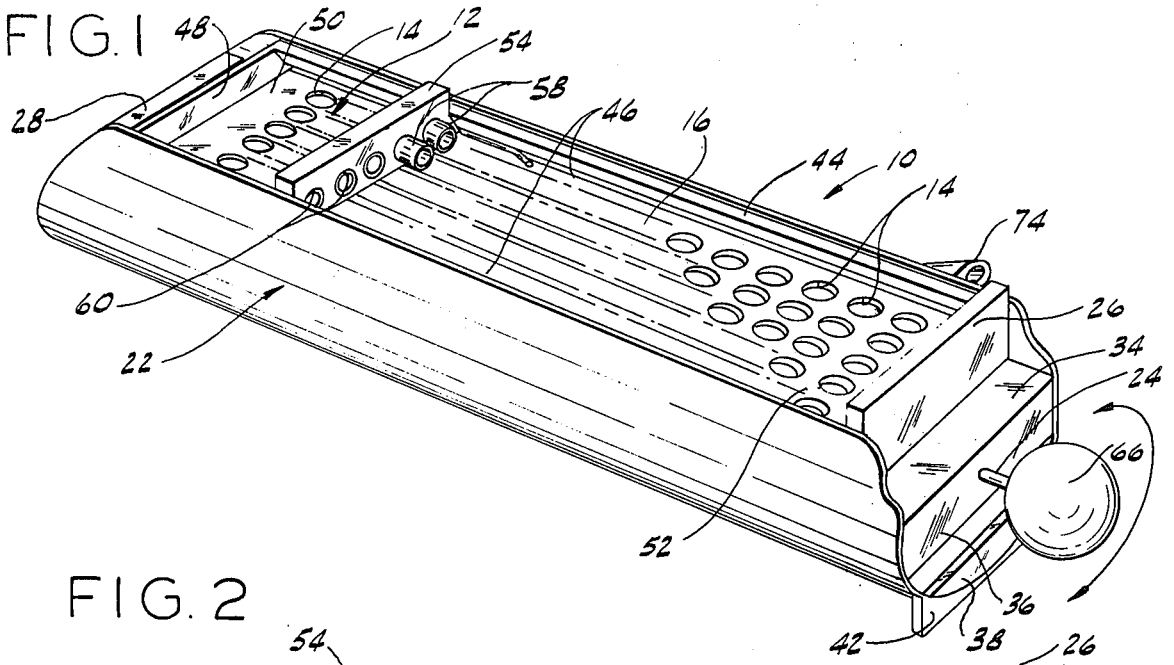
Figure 2:
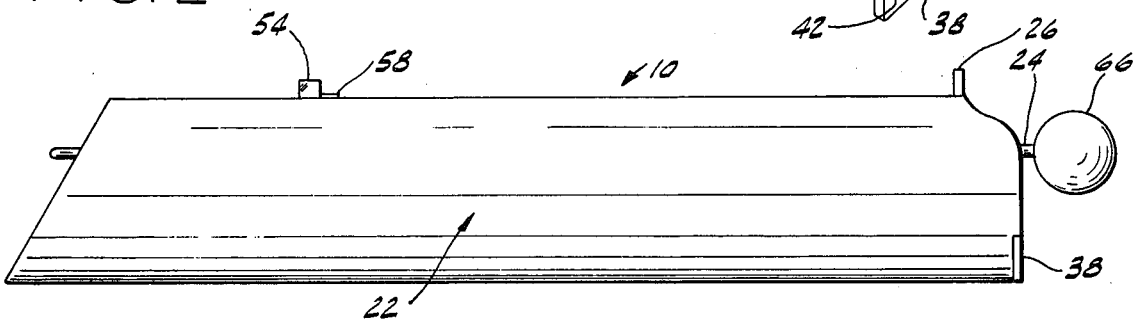
FIG. 2 is a side elevational view of the counter.

Fingers 58 for use as described hereinafter are friction fitted or the like in apertures 60 provided in sliders 54 and 56. There are five fingers 58 fitted in five apertures 60 in slider 54 and three fingers 58 fitted in three apertures 60 in slider 56. Fingers 58 are aligned with recesses 14 and 18 so that they block selected recesses as desired. To this end, fingers 58 may be independently moved so that they extend on the right or left of sliders 54 and 56 as viewed in the figures. As seen in FIG. 1, two of fingers 58 extend to the right of slider 54 and three extend to the left. In the other figures, fingers 58 are shown to the right of the slider in full lines and moved to the left in broken lines.

Recesses 14 and 18 must be arranged on sides 16 and 20, respectively, to leave a safety zone 59 at end 50 wide enough to accommodate sliders 54 and 56, respectively, so that fingers 58 do not block the last rank of recesses. This is necessary so that a full 100 pills may be counted on pill side 16 and 102 capsules counted on capsule side 20.

Figure 8:
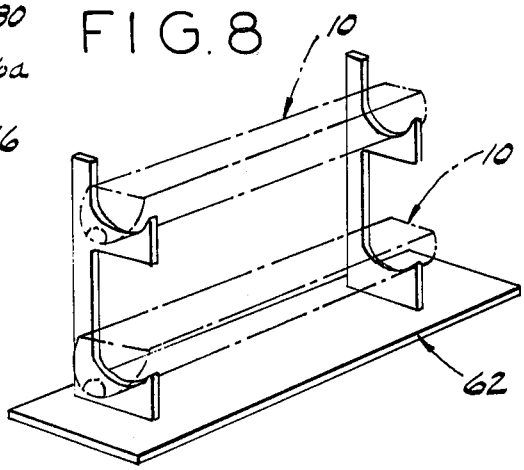
FIG. 8 is a perspective view of a holder for a pair of counters constructed according to the present teachings and differing only in the size of the pill and capsule receiving recesses.

In use for example with pills, counter 10 having pill receiving recesses 14 of an appropriate size is selected from a rack 62 as shown in FIG. 8. The operator then moves slider 54 along groove 57 on wires **57*a* into the selected position. If the number of pills to be counted is an even multiple of five, all of fingers 58 are left on the right side of slider 54 as viewed in FIG. 3. However, if an uneven multiple of five is to be counted, the operator pushes the appropriate number of fingers 58 to the left so that selected recesses 14 are uncovered as shown in FIG. 1. In some cases, it is preferred that fingers 58 and apertures 60 be eliminated from sliders 54 and 56**. In these instances, uneven multiples are manually counted.

After the operator has positioned slider 54 and fingers 58 so that the number of available recesses 14 between slider 54 and housing end wall 26 is equal to the number of pills desired, pills are then poured from a bulk supply (not shown) onto tray 12 as shown in FIG. 1. The pills are preferably provided in a quantity substantially in excess of the number of pill receiving recesses between the slider and the end wall. Counter 10 is then shaken horizontally until a pill occupies each of the available recesses. Alternatively, counter 10 is stationary and the pills are pushed into the recesses with a spatula or the like.

Figure 5:
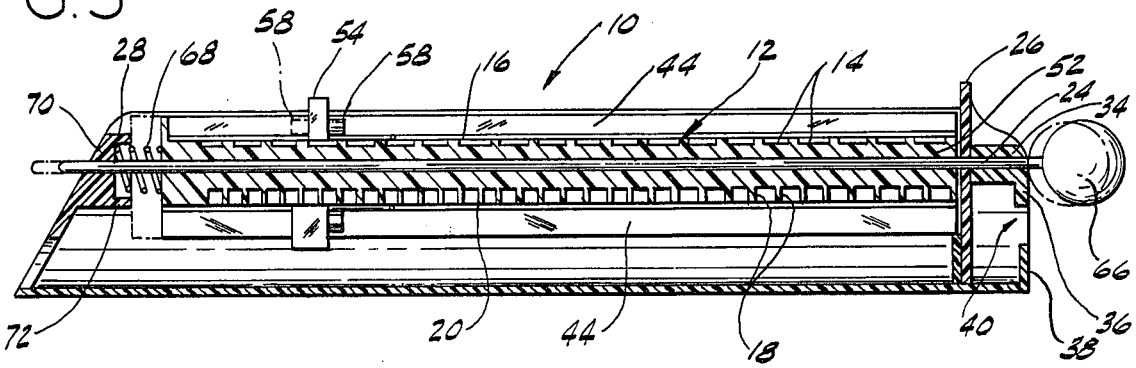
FIG. 5 is a longitudinal cross-section of the counter with the tray as shown in FIG. 3; shown in broken lines is the tray in moved position for ejecting excess pills.
Figure 6:
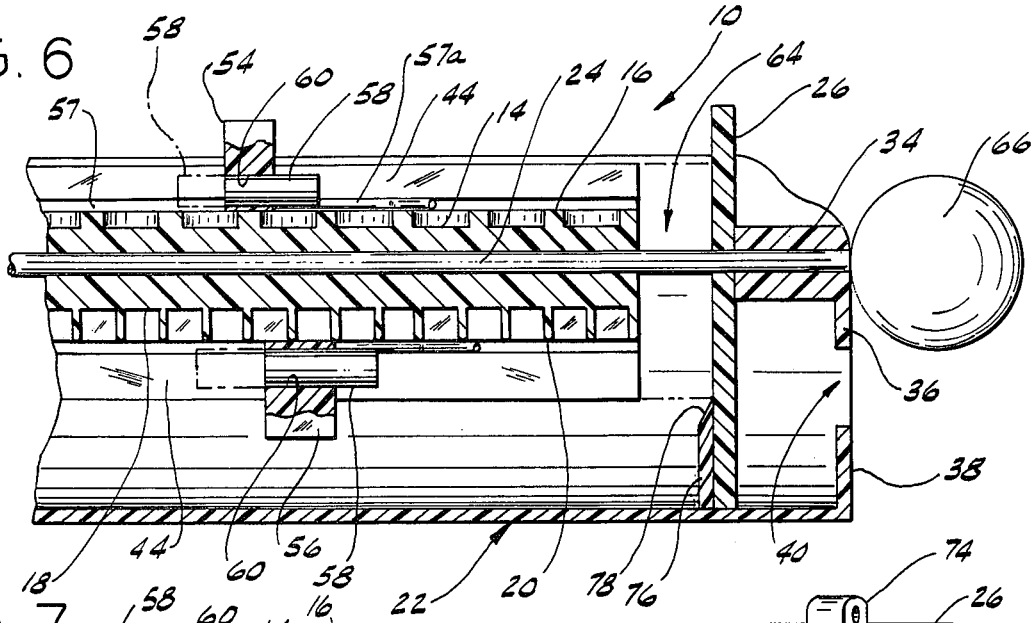
FIG. 6 is an enlarged longitudinal cross-section of the counter in pill ejecting position as shown in broken lines in FIG. 5 but with the left end of the counter broken away; shown in broken lines is the slider for counting odd numbers of pills or capsules in moved position.

Once pill receiving recesses 14 have been filled, excess pills are ejected by first pushing the tray to the left as shown in broken lines in FIG. 5 until it occupies the position shown in full lines in FIG. 6 and a gap 64 is opened between right end 52 of tray 12 and right housing end wall 26. This is accomplished by manually pushing an operator ball 66 to the left, which movement compresses a spring 68 and causes tray 12 to slide on shaft 24 along its journal supports in housing end walls 26 and 28. A flange 70 is attached to left housing end wall 28 through which shaft 24 is also journaled. As shown in FIG. 5, a recess 72 is provided in flange 70 as a retainer for spring 68. Ball 66 is spaced on shaft 24 from right housing end wall 26 to avoid contact with flange 34 until tray 12 is fully reciprocated on its journal supports. Gap 64 is sized so that the excess medicinal units are freely ejected therethrough as described hereinafter.

To eject excess pills, counter 10 is lifted so that the left end is elevated with respect to the right end as viewed in the figures. Excess pills are then either vibrated off tray 12 or pushed off with a spatula through gap 64 into the bottom of counter 10 under tray 12. They are returned to the bulk supply through spout 32 when counter 10 is lifted so that the right end is elevated with respect to the left end as viewed in the figures.

Any damaged pills in recesses 14 may be readily observed and then removed with a pin (not shown) which is retained in a boss 74. Additional pills are then poured onto tray 12, counter 10 shaken to fill the recesses of the rejected pills and the excess pills ejected as above.

With selected recesses 14 filled with whole pills and with tray 12 in the position shown in full lines in FIG. 5, operator ball 66 is pushed slightly to the left into the position shown in broken lines and then ball 66 is rotated one-half turn either to the right or to the left.

Operator ball 66 must be pushed to the left to disengage right end 52 of tray 12 from arc 76 attached to the inside of right housing end wall 26 whose upwardly extending ends 78 provide an abutment surface preventing tray 12 from inadvertently rotating. As tray 12 is turned over so that pill side 16 is down, the pills drop out of recesses 14 into the bottom of counter 10. The counted pills are then poured into a prescription bottle or other container through spout 32 in the same way that excess pills are ejected as described above.

Capsules are counted in a similar manner to that described for counting pills except that capsule side 20 is up when the capsules are poured from the bulk supply.

Counter 10 is preferably constructed of some durable plastic material which can be easily cleaned or sterilized but is yet inexpensive to manufacture. Tray 12 is preferably opaque with cavities 80 to reduce the weight while housing 22 and end walls 26 and 28 are preferably transparent so that all pills and capsules admitted to the counter may be observed and removed.

From the foregoing description, it is clear that the present device provides an easy to use improved means for counting both pills and capsules wherein excess or imperfect medicinal units are easily removed and counted units are quickly dispensed.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A counter for pills and capsules having a tray with pill and capsule receiving sides in back to back relationship, each side having a movable slide for selecting the number of recesses in said side to be filled, said tray being elongated and rotatable within a housing about a central axis to dispense the counted pills or capsules into said housing.

2. The counter according to claim 1 wherein the tray is supported at its opposite ends by a shaft which is rotatably journaled in a housing.

3. The counter according to claim 2 wherein the housing is arcuate in cross-section and has first and second end walls, said tray being journaled in said first and second end walls and wherein the first end wall is formed adjacent one edge of the housing at an acute angle to the long axis thereof, said first end wall having an aperture forming a pouring spout.

4. The counter according to claim 3 wherein the tray has side flanges, an end flange and is open at one end, said side and end flanges bending toward the pill and capsule receiving sides.

5. The counter according to claim 4 wherein the recesses on the pill and capsule receiving sides are arranged in ranks and files.

6. The counter according to claim 5 wherein the tray is resiliently biased between said first and second end walls and is reciprocated by an operator member associated with one end of the shaft.

7. The counter according to claim 6 wherein the tray is resiliently biased by a coil spring fitted over the shaft opposite the operator member, said spring received in a recess provided in the first end wall.

8. The counter according to claim 7 wherein the tray is reciprocated between the first and second end walls so that a gap is selectively provided between the open end of the tray and the second end wall sufficiently large to eject excess pills and capsules when the first end wall of the tray is elevated with respect to the second end wall.

9. The counter according to claim 8 wherein the sliders have sloping sides which are cooperatively fitted between the sloping side flanges of the tray.

10. The counter according to claim 9 wherein the sliders have resiliently biased wires attached to their sloping sides for cooperative receipt in a longitudinal groove provided in each side flange of the tray.

11. The counter according to claim 10 wherein the sliders have movable fingers frictionally fitted in apertures provided therein, said fingers being in alignment with the recesses for selective blocking thereof.

12. The counter according to claim 11 wherein a leg is provided adjacent the second end wall to support the counter upright in rest position on a horizontal surface.

13. The counter according to claim 12 wherein the tray is arcuate in cross-section and dimensioned to exclude a pill or capsule in the space between the tray and the housing.

* * * * *

UNITED STATES PATENT AND TRADEMARK OFFICE

CERTIFICATE OF CORRECTION

PATENT NO. : 4,047,620

DATED : September 13, 1977

INVENTOR(S) : Warren L. Deininger

It is certified that error appears in the above-identified patent and that said Letters Patent are hereby corrected as shown below:

IN THE CLAIMS:

Claim 1, column 5, line 38, "slide" should read -- slider --.

Claim 2, column 5, line 45, "a housing" should read -- the housing --.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*